United States Patent [19]

Lenting et al.

[11] Patent Number: 4,632,135

[45] Date of Patent: Dec. 30, 1986

[54] HAIR-GROOMING MEANS

[75] Inventors: Gerard J. Lenting, Groningen; Roelof H. Sytsma, Drachten, both of Netherlands

[73] Assignee: U.S. Philips Corporation, New York, N.Y.

[21] Appl. No.: 691,596

[22] Filed: Jan. 15, 1985

[30] Foreign Application Priority Data

Jan. 17, 1984 [NL] Netherlands ..... 8400141

[51] Int. Cl.[4] ..... A45D 44/18

[52] U.S. Cl. ..... 132/85; 132/11 R; 132/152

[58] Field of Search ..... 132/84 R, 85, 1 R, 9, 132/11 R, 152; 604/20

[56] References Cited

U.S. PATENT DOCUMENTS

| | | | |
|---|---|---|---|
| 3,478,741 | 11/1969 | Simor | 604/20 |
| 3,520,297 | 7/1970 | Bechtold | 604/20 |
| 3,831,598 | 8/1974 | Tice | 604/20 |
| 3,927,684 | 12/1975 | Lam | 132/11 R |
| 4,329,567 | 5/1982 | Kunz et al. | 132/11 R |
| 4,502,497 | 3/1985 | Siahou | 132/84 R |
| 4,526,570 | 7/1985 | Nakagawa | 604/20 |

*Primary Examiner*—John J. Wilson

*Attorney, Agent, or Firm*—Rolf E. Schneider

[57] ABSTRACT

A hair-grooming device comprises a hollow elongate holder having a comb or brush attachment fitted onto one end portion thereof. A high-voltage source is enclosed in the holder for ion-generation. An elongate conductive support is mounted in and insulated from the holder and electrically connected to the high-voltage source, such support extending parallel to and opposite the attachment. At least one row of electrodes extends outwardly from the support toward the holder. There is a slot-like opening in the holder adjacent the attachment for each row of electrodes, the electrodes in each row extending toward the corresponding opening for escape of the formed ions through such opening to the exterior of the holder.

4 Claims, 3 Drawing Figures

HAIR-GROOMING MEANS

This invention relates to a hair-grooming means comprising a holder provided with a comb or brush attachment.

Such a hair-grooming means is generally known and is referred to as a hair comb or a hair brush. Depending on its construction, it may be used for untangling, styling and/or cleaning the hair.

During use such hair-grooming means may produce a static electric charge on the surface of the hair. Experiments have demonstrated that the resulting electric charge is positive and is caused by mechanical friction between the comb or brush attachment and the hair, which results in electrons being withdrawn from the hair. The magnitude of the static electric charge depends inter alia on climatological conditions and the thickness of the hairs, whilst moreover the spacing of the teeth of the comb attachment or the bristles of the brush attachment plays an important part.

The occurrence of the afore-mentioned effect during combing or brushing of the hair by means of such hair-grooming means is annoying and complicates hair-grooming, in particular hair-styling.

The present invention aims at improving such hair-grooming means so as to preclude any annoying effects of statically charged hair during use of said means.

To this end the hair-grooming means in accordance with the invention is characterized in that the hair-grooming means comprises a device for generating ions in air, which device comprises a high-voltage source arranged in the holder and a plurality of electrodes which are electrically connected to said source and which project into the air near the attachment.

In the switched-on condition the high-voltage source produces such a high voltage on the electrodes that the air around the electrodes is ionized owing to the high electric field strength at the free ends of the electrodes thereby producing negative ions. It has been found that an ion cloud can be produced around the electrodes by a voltage of a few kilovolts, for example in the range from −7 kV to −3.5 kV.

An advantage of the hair-grooming means in accordance with the invention is that it immediately neutralizes the positive charge of the hair caused by the friction between the hair and the movement of the brush-shaped or comb-like attachment over the hair. The positively charged hair has an electron deficiency which is replenished immediately with electrons produced by the negative ions generated in and around the attachment and hence in the air in the proximity of the hair.

A suitable embodiment of the invention is characterized in that the electrodes are secured to an elongate conductive support which is arranged in a hollow and which extends parallel to and opposite the attachment, the holder having an opening at the location of the electrodes.

An advantage of this embodiment is that the electrodes can be arranged in one or more rows adjacent each other in a simple, yet stable and safe manner. Depending on the number of electrodes one or more openings may be formed in the holder. Via the openings air can flow past the electrodes and the ions formed can escape to the exterior. Preferably, the free ends of the electrodes project into the opening in order to minimize the distance between the electrodes and the hair. This arrangement enhances the neutralizing effect.

In principle, the electrodes may be made of any conductive material such as copper or amorphous iron. In order to promote the emission of electrons from the free ends of the electrodes the electrodes are constructed as thin rods or as bundles of thin wires. The support for the electrodes may be for example a conducting wire of copper with a circular, rectangular, U-shaped or other cross-section. Alternatively, the support may be made of a non-conducting plastic, in which case the support is provided with a conductive coating. The electrodes may be secured to the support by means of an adhesive, by clamping or by spot-welding.

A particularly favourable embodiment is characterized in that the high-voltage source comprises an electronic system and an electric cell which cooperates with the electronic system and which can be fitted into the holder.

For proper operation of the hair-grooming means in accordance with the invention the frequency of the high-voltage pulses produced when the high-voltage source is switched on must be sufficiently high. If the frequency is too low the number of ions formed in the air will not suffice to completely neutralize the positive charge of the hair being treated. Although in principle any high-voltage source may be used, for example a piezoelectric element in conjunction with a bimetal, it has been found that a reliable and safe high-voltage source can be obtained by means of the elements of the last-mentioned embodiment. Preferably, the electronic system comprises an oscillator, a switching transistor and a high-voltage transformer.

The invention will now be described in more detail with reference to the accompanying drawing, in which.

Figure 1:
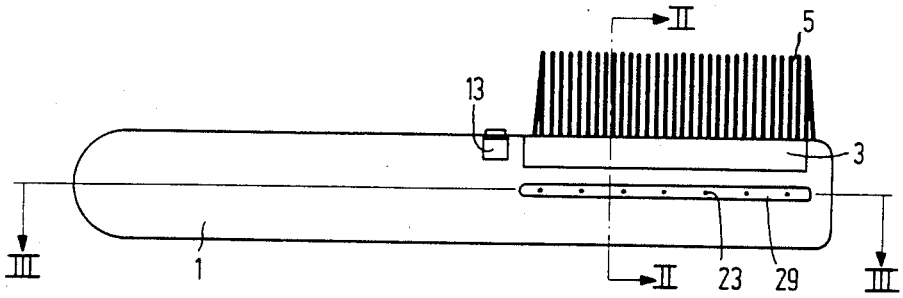
FIG. 1 is a side view of a hair-grooming means embodying the invention.
Figure 2:
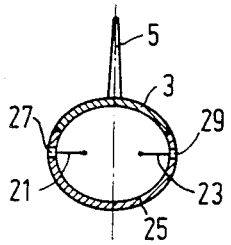
FIG. 2 is a cross-sectional view taken on the line II—II in FIG. 1.
Figure 3:
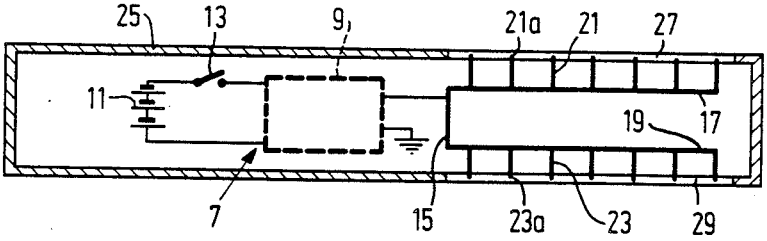
FIG. 3 is a longitudinal sectional view taken on the line III—III in FIG. 1.

The hair-grooming means embodying the invention shown in FIGS. 1, 2 and 3 comprises a hollow elongate holder 1 of acryl butadiene styrene onto one end portion of which a comb attachment 3 is fitted, which attachment includes a plurality of teeth 5. The holder 1 encloses a high-voltage source 7, which is shown schematically and which comprises an electronic system 9 and three rechargeable cells 11 which can be electrically connected to said system. A switch 13 is arranged between the electronic system 9 and the cells 11.

In the present embodiment the electronic system 9 comprises an oscillator, a switching transistor, and a high-voltage transformer. In the switched-on condition the electronic system 9 generates a pulse-shaped high voltage of 4.0 kV having a frequency of 200 Hz, from a direct voltage of 4.5 V.

The high-voltage source 7 is electrically connected to a U-shaped elongate conductive support 15 which is mounted in and insulated from the hollow holder 1, which support comprises limbs 17 and 19 carrying seven outwardly directed filamentary electrodes 21 and 23, respectively. The support 15 and the electrodes 21 and 23 are made of amorphous iron. The wall 25 of the holder 1 is formed with two diametrical slots 27 and 29 into which the free ends **21*a* and 23*a* of the electrodes 21 and 23 respectively, extend adjacent the comb attachment 3**.

What is claimed is:

1. A hair-grooming device comprising a hollow elongate holder; a comb or brush attachment fitted onto one end portion of the holder; a high-voltage source enclosed in the holder for ion-generation; an elongate conductive support mounted in and insulated from the holder and electrically connected to said high-voltage source, said support extending parallel to and opposite the attachment; at least one row of electrodes extending outwardly from said support toward the holder; and a slot-like opening in the holder adjacent the attachment for each row of electrodes, the electrodes in each row extending toward the corresponding opening for escape of the formed ions through such opening to the exterior of the holder.

2. A hair-grooming device according to claim 1, in which the free ends of the electrodes in each row project into the corresponding opening in the holder.

3. A hair-grooming device according to claim 1, in which the high-voltage source comprises an electronic system and an electric cell cooperating with the electronic system.

4. A hair-grooming device according to claim 3, in which the electronic system comprises an oscillator, a switching transistor, and a high-voltage transformer.

* * * * *